US012178332B2

(12) United States Patent
Ackerman et al.

(10) Patent No.: US 12,178,332 B2
(45) Date of Patent: Dec. 31, 2024

(54) BREATHABLE CRIB BED AND BUMPER SYSTEM

(71) Applicants: Mary Ackerman, Pensacola, FL (US); Ruth Ackerman, Winter Springs, FL (US)

(72) Inventors: Mary Ackerman, Pensacola, FL (US); Ruth Ackerman, Winter Springs, FL (US)

(73) Assignee: Ackerman and Ackerman Enterprises LLC, Winter Springs, FL (US)

( * ) Notice: Subject to any disclaimer, the term of this patent is extended or adjusted under 35 U.S.C. 154(b) by 80 days.

(21) Appl. No.: 17/983,222

(22) Filed: Nov. 8, 2022

(65) Prior Publication Data

US 2024/0148164 A1 May 9, 2024

(51) Int. Cl.
*A47D 15/00* (2006.01)
*A47D 9/00* (2006.01)

(52) U.S. Cl.
CPC ..... *A47D 15/008* (2013.01); *A47D 9/00* (2013.01)

(58) Field of Classification Search
None
See application file for complete search history.

(56) References Cited

U.S. PATENT DOCUMENTS

| | | | | |
|---|---|---|---|---|
| 6,119,288 | A * | 9/2000 | Hendrickson | A47D 13/063 5/98.1 |
| 6,438,775 | B1 * | 8/2002 | Koenig | A47D 15/008 5/946 |
| 7,793,368 | B2 | 9/2010 | Burrell, IV | |
| 9,038,222 | B2 | 5/2015 | Cicci | |
| 9,622,592 | B2 | 4/2017 | Barron et al. | |
| 2019/0261791 | A1 * | 8/2019 | Marton | A47G 9/0223 |

* cited by examiner

*Primary Examiner* — Adam C Ortiz
(74) *Attorney, Agent, or Firm* — Jason T. Dnaiel, Esq.; Daniel Law Offices, P.A.

(57) ABSTRACT

A breathable crib bed and bumper system includes a bed frame having a plurality of raised side panels, an open top end and an open bottom end. A series of air holes are positioned through each of the raised side panels, and connectors are positioned along the outer surfaces of each of the raised side panels. A breathable mesh topper is connected to the frame by the connectors and is suspended above the open top end of the frame. Impact resistant padding is positioned along the frame panels. A breathable crib bumper having a flat bottom surface is positioned between the bottom of the frame and a crib support. The bumper includes a plurality of breathable raised side walls that are connected to the raised side walls of the crib.

10 Claims, 4 Drawing Sheets

BREATHABLE CRIB BED AND BUMPER SYSTEM

TECHNICAL FIELD

The present invention relates generally to bedding for infants and toddlers, and more particularly to a breathable bed and bumper for use in a crib to reduce the risk of suffocation.

BACKGROUND

The statements in this section merely provide background information related to the present disclosure and may not constitute prior art.

In the United States alone, more than 3,000 babies die suddenly and unexpectedly when sleeping. Although sudden infant death syndrome (SIDS) is believed to be a root cause in many of these tragic deaths, many others are the result of suffocation. Although parents are taught to place a child on their back within a crib, it is not uncommon for the child to roll over such that their nose and mouth are against objects within the crib such as the crib mattress, or bumpers, for example. When this happens, the child may not be able to separate themselves from the object before lack of oxygen takes effect.

Although there are many sleeping aids such as braces and specialty-shaped pillows that attempt to keep the child from rolling over inside a crib, there are times where these items fail to perform as intended. Indeed, in such occurrences, the "safety" device then acts as another object from which the child could suffocate. In addition to the above, many children suffocate from contact with protective padded bumpers placed along the edges of the mattress against the crib walls. In addition to suffocation, some children are hurt when attempting to climb between the bars of the crib.

Accordingly, it would be beneficial to provide a breathable crib bed and bumper system that can reduce the risk of suffocation, and that does not suffer from the above noted deficiencies.

SUMMARY OF THE INVENTION

The present invention is directed to a crib bed and bumper system. One embodiment of the present invention can include a bed frame having a plurality of raised side panels, an open top end, and an open bottom end. A series of air holes can be positioned through each of the raised side panels, and connectors can be positioned along the outer surfaces of each of the raised side panels.

A breathable mesh topper can be suspended above the open top end of the frame. The mesh topper can include a front panel, a back panel, and a pair of side panels that are connected to the front, back and side panels of the frame, respectively. A plurality of connectors along the frame and topper allows the tension of the mesh topper to be adjustable, and impact resistant padding is positioned along the frame panels.

One embodiment of the present invention also includes a breathable crib bumper having a flat bottom surface and a plurality of raised side walls. The bottom surface can be positioned along the onto the flat crib support spring or lattice, and the side panels can be connected to the raised side walls of the crib. The bed frame and topper are then positioned inside the crib such that the bed is resting on the flat bottom surface of the crib bumper.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
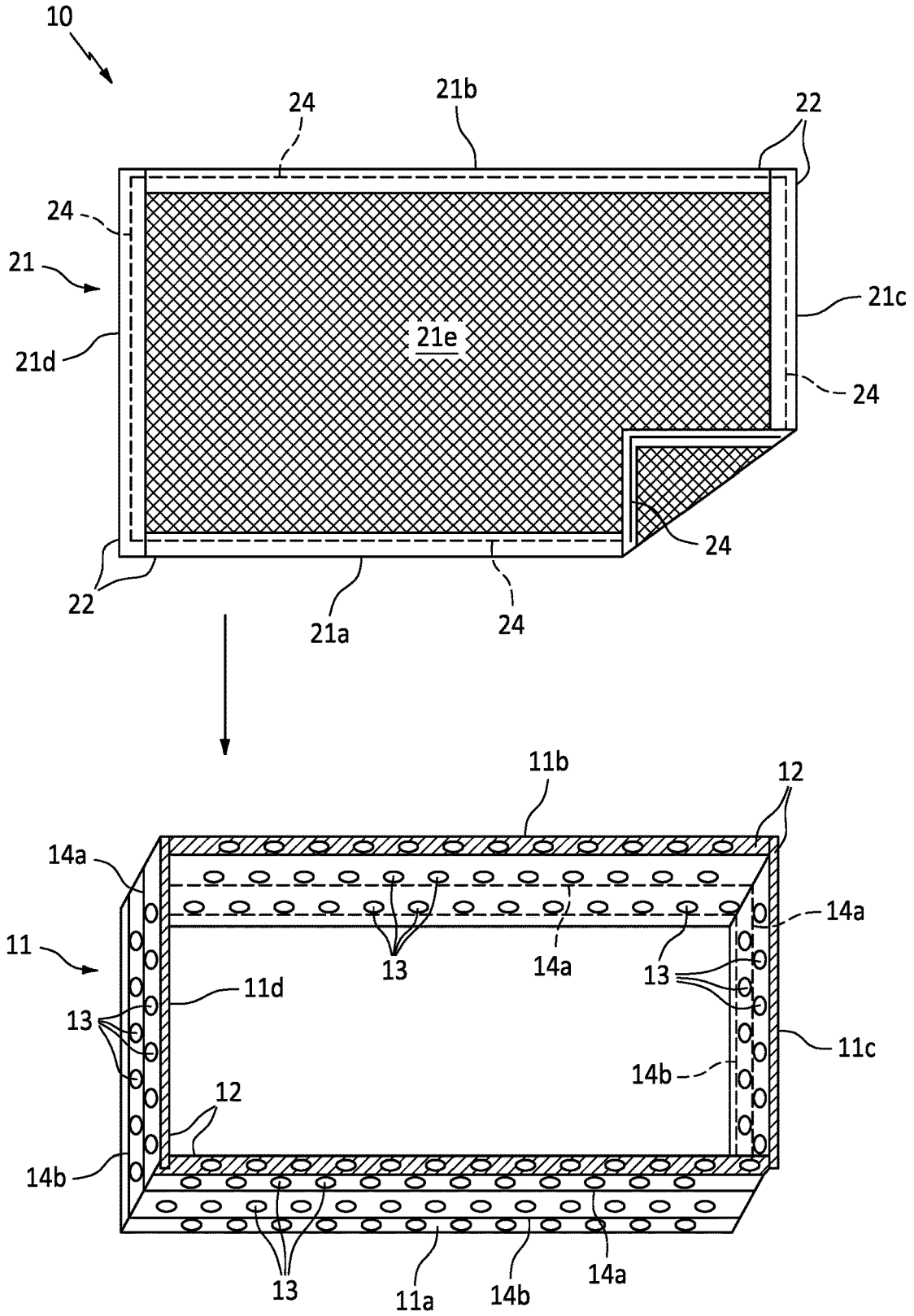
FIG. 1 is an exploded parts view of the breathable crib bed that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. A "complementary connector" is another connector that works with the first connector together to repeatedly join two items together in a nonpermanent manner. Several nonlimiting examples of connectors and complementary connectors include, but are not limited to, flexible strips of interlocking projections with a slider (i.e., zipper), thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-4 illustrate one embodiment of a breathable crib bed and bumper system that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of a breathable crib bed 10 that includes a frame 11 and a mesh topper 21.

As shown, one embodiment of the frame 11 can include a front wall 11*a*, a back wall 11*b*, and a pair of side walls 11*c* and 11*d* that form a generally rectangular-shaped member having an open top end and an open bottom end. In the preferred embodiment, each of the walls 11*a*-11*d* can include, or can be lined with an impact resistant material 12 such as hard foam or cotton padding, for example, along the entirety or along the top surfaces.

In the preferred embodiment, a plurality of air holes 13 can be disposed along the length of each of the frame walls 11*a*-11*d* and throughout the impact resistant material 12 to permit air to flow freely between the area between the walls and the outside space. In the preferred embodiment, the air holes can be positioned between about 2 and 5 inches apart along the entirety of the frame and padded areas, so as to ensure a hole is positioned wherever a child's nose or mouth could be located when using the bed. Such a feature advantageously ensuring or reducing the likelihood that a child could suffocate from the frame itself.

In one embodiment, a first and second grouping of connectors 14*a* and 14*b* such as the illustrated strips of hook and loop material, for example, can be positioned along the walls 11*a*-11*d* to engage the complementary connectors 24 of the below described mesh topper. In the preferred embodiment, each connector of the first group of connectors 14*a* can be positioned at a first height along the frame walls, and each connector of the second group of connectors 14*b* can be positioned at a second height along the frame walls. Of course, other embodiments are contemplated wherein a different type, number or location of connectors are provided.

As described herein, the frame 11 can be constructed from any number of different materials that are, for example, relatively strong and stiff for their weight. Several nonlimiting examples include but are not limited to various metals or metal alloys, various plastics, and polymers, and/or various composite materials, for example. Of course, other embodiments are contemplated wherein the frame includes a different shape and/or different construction materials.

Although described and illustrated with regard to the frame including walls constructed from solid pieces of material having a plurality of air holes, other embodiments are contemplated wherein the frame includes different shapes and sizes. Moreover, one embodiment of the frame can be constructed whereby the frame walls 11*a*-11*d* each include an upper frame rod and a lower frame rod (e.g., plastic or metal tubing, for example) that are joined together at the corners of the frame by vertically oriented frame connectors, so as to create the rectangular-shaped frame. In such an embodiment, there will be an absence of material between the upper and lower frame rods to ensure full and complete passage of air.

In either instance, the mesh topper 21 can function to engage the frame 11 to act as the top surface of the assembled bed onto which the child is placed. In this regard, the mesh topper can include a shape and size that is complementary to the shape and size of the frame 11. In the illustrated embodiment, the mesh topper can include a front edge 21*a*, a back edge 21*b*, and a pair of side edges 21*c* and 21*d* that form a generally rectangular shaped center section 21*e*.

In the preferred embodiment, the mesh topper 21 can be constructed from a generally malleable and machine washable material such as nylon mesh netting, for example, and can include a layer of reinforced nylon 22 that is stitched or otherwise secured along the outer edges of the panel. The reinforced nylon can function to maintain the shape and structural integrity of the topper and can include a plurality of complementary connectors 24 such as the illustrated strips of hoop and loop material, for example, along a length thereof. Each of the complementary connectors 24 can include a location along the topper that is precisely positioned for engaging (at different times) one of the first connector 14*a* and the second connector 14*b* on the frame.

As is known in the art, mesh netting has inherently high tensile strength and is known to be extremely durable and lightweight. Moreover, the mesh construction results in thousands of individual openings between the netting layers, which make the panel completely breathable (e.g., defined herein as the ability of a material to allow air to pass therethrough such that when both of a person's nose and mouth are in complete contact with the surface the person is still able to breathe). Furthermore, by removably attaching the mesh netting onto the frame, the netting can be easily removed, cleaned, and replaced in a manner similar to traditional bed sheets, thus maintaining a safe and sanitary sleeping environment.

Although described above as including nylon mesh having a rectangular shape, this is for illustrative purposes only. To this end, other embodiments are contemplated wherein the topper 21 is constructed from other breathable materials or an assembly of materials that results in a breathable surface. Moreover, other shapes and sizes are contemplated for use with frame members having different shapes and sizes than what is shown and described herein.

Figure 2:
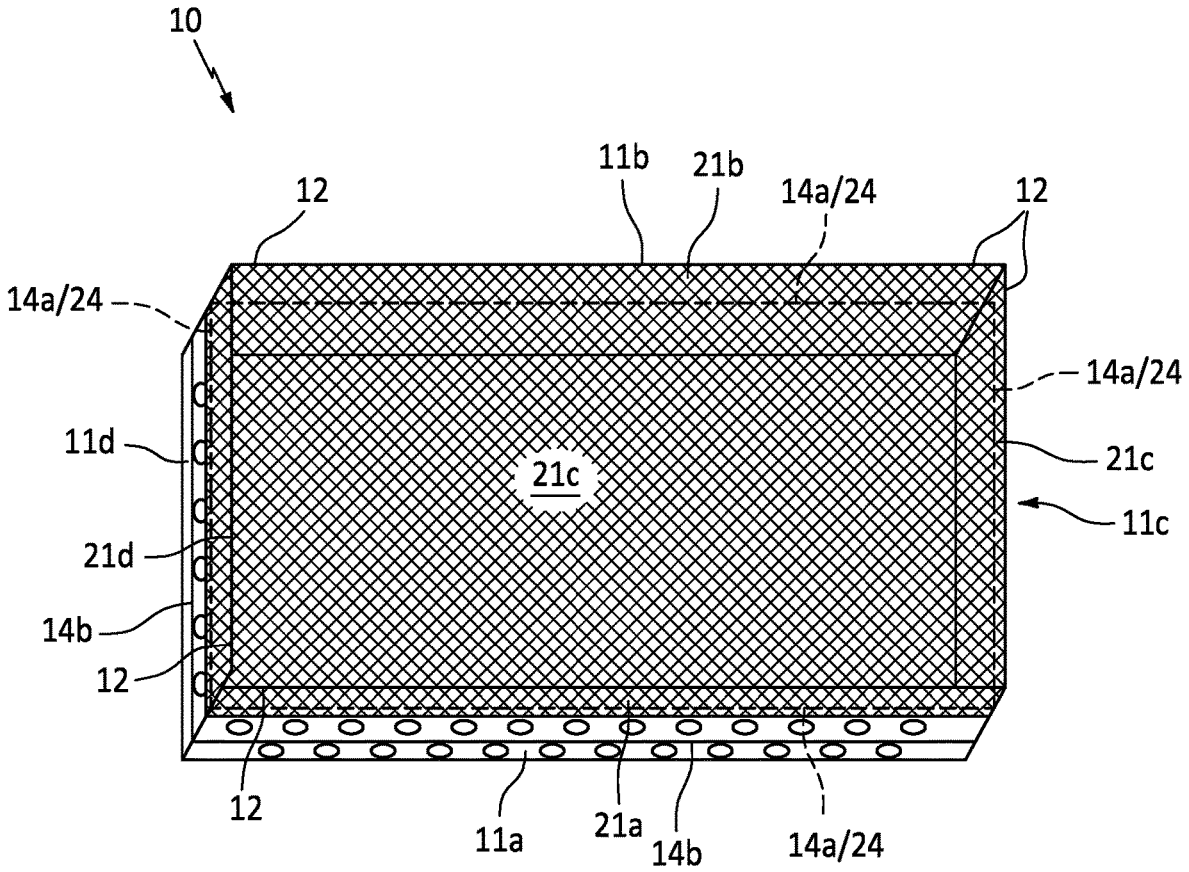
FIG. 2 is a perspective view of the bed of the breathable crib bed and bumper system, in accordance with one embodiment of the invention.

As shown at FIG. 2, the crib bed 10 can be assembled by aligning walls 11*a*, 11*b*, 11*c*, and 11*d* with edges 21*a*, 21*b*, 21*c* and 21*d*, respectively. When so positioned, the center section 21*e* will be suspended above the frame walls. Next, the complementary connectors 24 can engage the first or second group of connectors 14*a* and 14*b*. By providing groups of connectors at different heights (relative to the top and bottom surfaces of the frame walls), the system can allow a user to adjust the tension at which the topper 21 is connected to the frame. In this regard, when connecting to the second group 14*b*, the middle section 21*e* is more rigid than when the connectors 24 are engaged with the first group 14*a*. Such a feature advantageously allowing a parent to adjust the depth of the indentation formed when a child is placed onto the crib bed.

To this end, when positioned on their back in the center of the topper, the weight of the child creates an indentation (see lines I at FIG. 4) which assists to maintain the child on their back. This indentation can be adjusted by selection of either the first or second group of connectors. In this regard the indentation is most desirable for newborns and extremely young babies to prevent them from rolling or moving when sleeping. Conversely, older babies (e.g., older than 6 months) would benefit from less indentation to allow them to slightly move when sleeping.

In either instance, if/when the child moves or crawls along the bed, the padding 12 prevents injury to the child if they hit their head on the frame. Finally, owing to the breathable nature of the topper 21, and the air holes 13, the child is able to breathe at all times regardless of whether they are sleeping on their back or sides. Moreover, if they roll onto a face down position with their mouth and nose in direct contact with the topper, the breathable material ensures they will still be able to breathe at all times.

Figure 3:
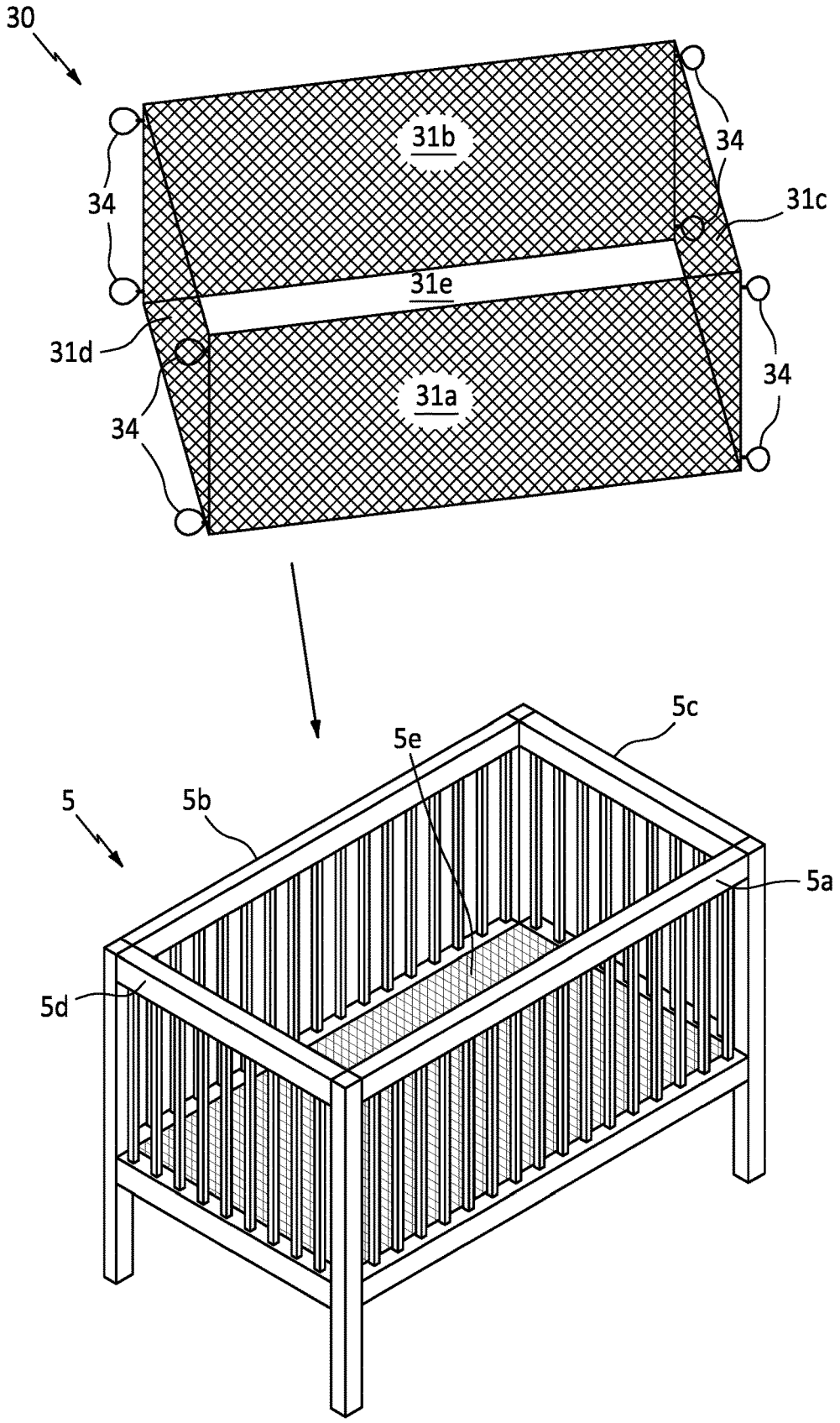
FIG. 3 is a perspective view of the bumper of the breathable crib bed and bumper system, in accordance with one embodiment of the invention.

FIG. 3 illustrates one embodiment of a breathable crib bumper 30 for use with the above-described bed 10 inside a crib 5. As shown, the crib bumper 30 can include a front panel 31*a*, a back panel 31*b*, a pair of side panels 31*c* and 31*d*, and a bottom panel 31*e* that is connected to the bottom end of each of the panels 31*a*-31*d*.

The bumper 30 is designed to be positioned within the sleeping area of a crib 5 such that the bottom panel 31*e* rests horizontally along the crib support spring or lattice 5*e*, and each of the panels 31*a*-31*d* extend upward along the four vertical crib walls 5*a*, 5*b*, 5*c* and 5*d*. In this regard, the bottom panel 31*e* can include a shape and size that is complementary to the shape and size of the frame 21. In the preferred embodiment, a plurality of crib connectors 34 such as elastic tethers, for example, can be provided along the panels and can function to secure each panel of the bumper onto the crib.

As described herein, each of the panels 31*a*-31*d* can also be constructed from breathable mesh netting, so as to not create a suffocation hazard to a child within the crib, and to allow a parent to see through the openings in the mesh material so as to view the child at all times.

Figure 4:
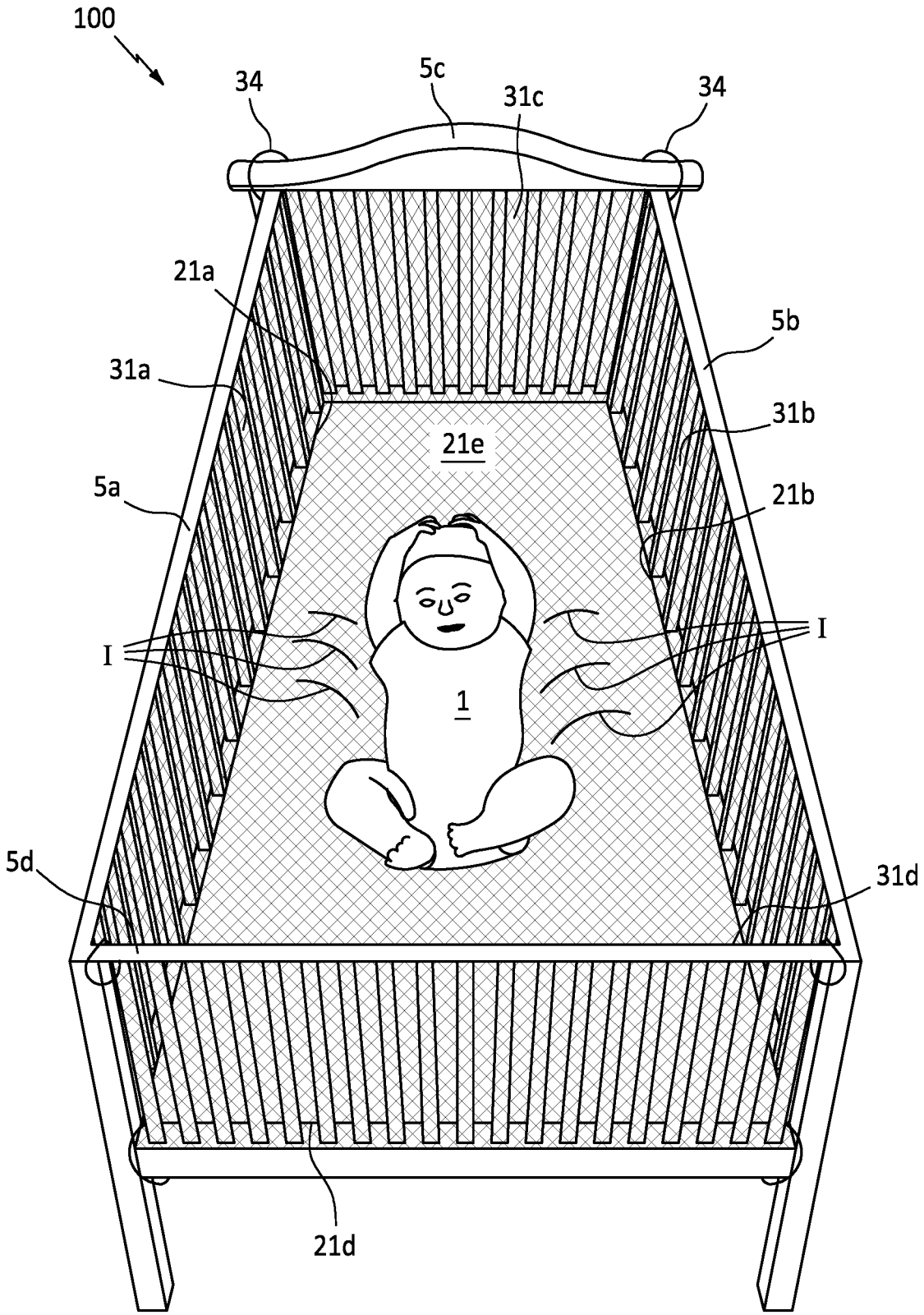
FIG. 4 is a perspective view of the breathable crib bed and bumper system in operation, in accordance with one embodiment of the invention.

As shown at FIG. 4, the above-described bed and bumper form a system 100 for transforming any crib 5 into a safe sleeping area for a child 1 that reduces the likelihood of injuries resulting from contact with the crib bars because the panels 31*a*-31*d* prevent the child from putting their arms through the bars. Additionally, the bed and bumper system reduce the likelihood of suffocation by providing breathable contact surfaces along the bed 21*e* and against the crib sides via panels 31*a*-31*d*.

Although described above for use with a child in a crib, this is for illustrative purposes only. To this end, other embodiments are contemplated wherein the bed is constructed for use by adults so as to be made to fit a twin, full, queen, king or California-king bed frame. Such a feature being particularly useful for aiding in individuals who are bedridden and have frequent soiling of the bed and/or other individuals who need full air along as much of their body as possible.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A crib bed, comprising:

a frame having a front panel, a back panel, a pair of side panels, a top end and a bottom end, wherein the frame comprises a first material;

a plurality of connectors that are disposed along the frame;

a topper having a front edge, a back edge, a pair of side edges, and a center section, wherein the topper is configured to support a child when the child is placed in the bed; and a plurality of complementary connectors that are disposed along the topper;

wherein the frame is configured to be positioned within a crib, each of the plurality of connectors and complementary connectors are configured to removably secure the topper onto the frame;

an impact resistant material that is positioned along a top end of each of the front panel, the back panel and the pair of side panels; wherein the impact resistant material comprises a second material; wherein the first material is different from the second material; wherein the impact resistant material comprises top surface and a bottom surface; wherein the bottom surface of the impact resistant material abuts the top end of each of the front panel, the back panel and the pair of side panels; wherein the top surface of the impact resistant material abuts the toper; and a plurality of air holes that pass from the top surface of the impact resistant material through the impact resistant material to the bottom surface of the impact resistant material.

2. The bed of claim 1, wherein each of the top end and the bottom end of the frame are open.

3. The bed of claim 2, wherein the center section of the topper is suspended above the open top end of the frame when the frame and topper are secured together.

4. The bed of claim 3, wherein the topper is constructed from a mesh material.

5. The bed of claim 4, wherein the mesh material is breathable.

6. The bed of claim 1, further comprising:

a plurality of air holes that are disposed along each of the front panel, the back panel and the pair of side panels.

7. The bed of claim 1, further comprising:

an impact resistant material that is positioned along at least one of the front panel, the back panel and the pair of side panels.

8. The bed of claim 1, further comprising another plurality of air holes that are disposed along each of the front panel, the back panel, and the pair of side panels.

9. The bed of claim 1, wherein the plurality of air holes are vertical air holes.

10. The bed of claim 8, wherein the plurality of air holes are perpendicular to the another plurality of air holes.

* * * * *